US011053821B2

(12) United States Patent
Cecur

(10) Patent No.: US 11,053,821 B2
(45) **Date of Patent: *Jul. 6, 2021**

(54) VALVETRAIN FOR DIESEL ENGINE HAVING DE-COMPRESSION ENGINE BRAKE

(71) Applicant: Eaton Intelligent Power Limited, Dublin (IE)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 343 days.

This patent is subject to a terminal disclaimer.

(21) Appl. No.: 15/738,668

(22) PCT Filed: Jun. 24, 2016

(86) PCT No.: PCT/EP2016/064662

§ 371 (c)(1),
(2) Date: Dec. 21, 2017

(87) PCT Pub. No.: WO2016/207348

PCT Pub. Date: Dec. 29, 2016

(65) Prior Publication Data

US 2018/0187579 A1 Jul. 5, 2018

(30) Foreign Application Priority Data

Jun. 24, 2015 (GB) ..... 1511117

(51) Int. Cl.

| | |
|---|---|
| ***F01L 13/06*** | (2006.01) |
| ***F01L 1/26*** | (2006.01) |
| ***F01L 1/18*** | (2006.01) |

(52) U.S. Cl.
CPC ..... *F01L 13/06* (2013.01); *F01L 1/18* (2013.01); *F01L 1/26* (2013.01)

(58) Field of Classification Search
CPC . F01L 13/06; F01L 13/065; F01L 1/18; F01L 1/26; F02D 13/04

(Continued)

(56) References Cited

U.S. PATENT DOCUMENTS 6,354,265 B1 * 3/2002 Hampton ..... F01L 1/181 123/321
6,386,160 B1 * 5/2002 Meneely ..... F01L 13/065 123/90.12

(Continued)

FOREIGN PATENT DOCUMENTS

CN 202140128 U 2/2012
CN 102635417 A 8/2012

(Continued)

*Primary Examiner* — Gonzalo Laguarda
(74) *Attorney, Agent, or Firm* — Leydig, Voit & Mayer, Ltd.

(57) ABSTRACT

An engine brake rocker arm assembly operable in an engine drive mode and an engine braking mode, the engine brake rocker arm assembly selectively opening first and second exhaust valves, includes: an exhaust valve rocker arm assembly having an exhaust rocker arm that rotates around a rocker shaft; and an engine brake actuation assembly including an actuator assembly; an actuator lever; and a mechanically controlled engine brake actuator that moves between a first position corresponding to the engine brake mode in which the second exhaust valve is opened prior to the first exhaust valve, and a second position corresponding to the drive mode in which the second valve is not opened prior to the first exhaust valve.

22 Claims, 9 Drawing Sheets

(58) Field of Classification Search
USPC ..... 123/90.12, 90.15, 320, 90.25, 90.23, 123/90.39, 90.4, 90.41
See application file for complete search history.

(56) References Cited

U.S. PATENT DOCUMENTS

| | | | | |
|---|---|---|---|---|
| 10,294,828 | B2 * | 5/2019 | Cecur | F01L 1/24 |
| 2010/0006062 | A1 | 1/2010 | Yang | |
| 2013/0068195 | A1 | 3/2013 | Ruggiero et al. | |
| 2014/0083381 | A1 | 3/2014 | Roberts et al. | |
| 2015/0144096 | A1 * | 5/2015 | Meneely | F01L 9/02 123/321 |
| 2016/0356187 | A1 * | 12/2016 | Meneely | F01L 13/06 |
| 2017/0175597 | A1 * | 6/2017 | Cecur | F01L 1/16 |
| 2017/0276034 | A1 * | 9/2017 | Cecur | F01L 13/06 |

FOREIGN PATENT DOCUMENTS

| | | | |
|---|---|---|---|
| GB | 1238112 | A | 7/1971 |
| WO | WO 2015120897 | A1 | 8/2015 |

* cited by examiner

VALVETRAIN FOR DIESEL ENGINE HAVING DE-COMPRESSION ENGINE BRAKE

CROSS-REFERENCE TO PRIOR APPLICATIONS

This application is a U.S. National Phase application under 35 U.S.C. § 371 of International Application No. PCT/EP2016/064662, filed on Jun. 24, 2016, and claims benefit to Great Britain Patent Application No. GB 1511117.2, filed on Jun. 24, 2015. The International Application was published in English on Dec. 29, 2016 as WO 2016/207348 under PCT Article 21(2).

FIELD

The present disclosure relates generally to a rocker arm assembly for use in a valve train assembly and more particularly to a rocker arm assembly that opens only one exhaust valve during a braking event in a manner that does not create over lifting of exhaust valves in drive (combustion) mode.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In an embodiment, the present invention provides an engine brake rocker arm assembly operable in an engine drive mode and an engine braking mode, the engine brake rocker arm assembly selectively opening first and second exhaust valves and comprising: an exhaust valve rocker arm assembly having an exhaust rocker arm that is configured to rotate around a rocker shaft; and an engine brake actuation assembly comprising: an actuator assembly; an actuator lever; and a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
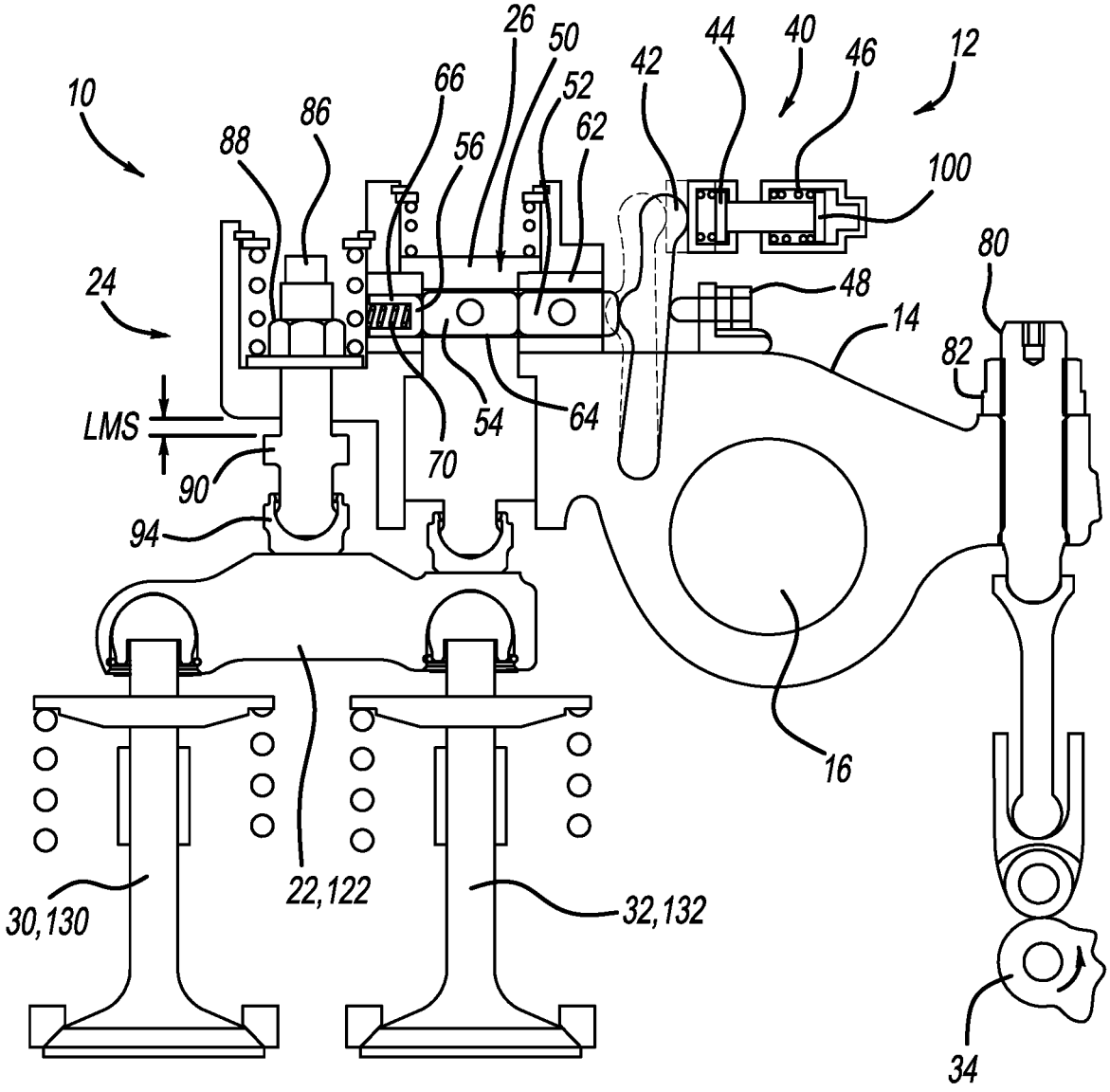
FIG. 1 is a cross-sectional side view of an exhaust rocker arm constructed in accordance to one example of the present disclosure and shown cooperating with a valve bridge and first and second exhaust valves.

According to additional features, the actuator assembly is hydraulically actuated and includes an actuator piston. The actuator piston translates within an actuation cylinder causing movement of the actuator lever and ultimately movement of the mechanically controlled engine brake actuator between the first and second positions. The actuator assembly further comprises an actuation shaft that extends out of the actuation cylinder and is coupled to a compliance piston received in a compliance cylinder. The actuator piston and the compliance piston translate together.

According to other features, the actuator assembly further comprises (i) an actuation piston return spring and (ii) a compliance spring. The actuation piston return spring is biased between the actuator piston and the actuation cylinder. The compliance spring is biased between the compliance piston and the compliance cylinder. The engine brake actuator comprises a first crown member, a second crown member and a crown biasing member that biases the first and second crown members apart. The first crown member comprises a series of first teeth and first valleys. The second crown member comprises a series of second teeth and second valleys. The first series of teeth oppose the second series of teeth in a latched position during the engine brake mode. The second series of teeth align with the first valleys in the unlatched position during the drive mode.

According to still other features, the first and second crown members rotate relative to each other when moving between the engine braking mode and the drive mode. The engine brake actuator collapses during the drive mode. A return spring is housed in a return spring housing and acts against the actuator lever to move the actuator lever toward the actuation shaft.

In other features, the actuator assembly includes a pneumatic actuator that operates pneumatically with pressurized air to actuate the actuator lever. In another configuration, the actuator assembly includes a solenoid actuator where the actuator lever is actuated by solenoid actuation. In another configuration, the actuator assembly includes an electromechanical actuator where the actuator lever actuates based on electromechanical operation. A first finger is coupled between the actuator lever and the first crown member. A second finger is coupled between the actuator lever and the second crown member. A spigot assembly is disposed in the exhaust rocker arm and is configured to engage a valve bridge engaged to the first and second exhaust valves.

An engine brake rocker arm assembly operable in a combustion engine mode and an engine braking mode according to another example of the present disclosure includes a rocker shaft, an exhaust valve rocker arm assembly, an actuator assembly and a latch pin assembly. The engine brake rocker arm assembly selectively opens first and second exhaust valves. The exhaust valve rocker arm assembly has an exhaust rocker arm that receives the rocker shaft and is configured to rotate around the rocker shaft. The actuator assembly includes an engine brake actuator, an actuator lever, an actuator piston and an actuator spring. The latch pin assembly cooperates with the actuator assembly. In combustion engine mode, the actuator piston and the actuator lever are in a retracted position such that the first and second exhaust valves move contemporary. In engine braking mode, the actuator piston and the actuator lever are in a forward position such that the latch pin assembly locks the engine brake actuator.

According to other features, the engine brake actuator is slidably received along an inner diameter of the exhaust valve rocker arm. The engine brake actuator is selectively translatable upon urging by the engine brake rocker arm. The engine brake actuator, in turn, urges one of the first and second exhaust valves open during engine braking mode. The latch pin assembly includes a first pin, a second pin and a third pin. The first pin is received by a first guide positioned in the exhaust rocker arm. The second pin is received by a second guide in the engine brake actuator. The third pin is received by a third guide in the exhaust rocker arm. A return spring urges the third pin toward the actuator lever. A registering bolt is configured to align the first, second and third latch pins.

Heavy duty (HD) diesel engines require high braking power, in particular at low engine speed. Some HD diesel engines are configured with valvetrains having a valve bridge and include with single overhead cam (SOHC) and overhead valve (OHV) valvetrain. The present disclosure provides high braking power without applying high load on the rest of the valvetrain (particularly the pushrod and camshaft). In this regard, the present disclosure provides a configuration that opens only one exhaust valve during a braking event. In one example, favorable force and rocker ratio are also provided in a manner that does not create "over lifting" of exhaust valves in drive (combustion) mode.

With initial reference to FIG. 1, an engine brake rocker arm assembly constructed in accordance to one example of the present disclosure is shown and generally identified at reference 10. The engine brake rocker arm assembly 10 includes an exhaust valve rocker arm assembly 12 incorporated in a valve train assembly that utilizes engine braking such as one having a pair of three-cylinder bank portions in a six-cylinder engine. It will be appreciated however that the present teachings are not so limited. In this regard, the present disclosure may be used in any valve train assembly, with a valve bridge that utilizes engine braking.

The exhaust valve rocker arm assembly 12 can include an exhaust rocker arm 14 that rotates about a rocker shaft 16. The rocker shaft 16 can be received by a valve train carrier and supports rotation of the exhaust rocker arm 14. The exhaust valve rocker arm assembly 12 can additionally include a valve bridge 22, a spigot assembly 24 and an engine brake actuator 26. The valve bridge 22 engages a first and second exhaust valve 30 and 32 associated with a cylinder of an engine. The exhaust rocker arm 14 rotates around the rocker shaft 16 based on a lift profile of a cam shaft 34.

The exhaust valve rocker arm assembly 12 can have an actuator assembly 40 having an actuator lever 42, an actuator piston 44, an actuator spring 46 and a registering bolt 48. The exhaust valve rocker arm assembly 12 can further include a latch pin assembly 50 that cooperates with the actuator assembly 40. The latch pin assembly 50 includes a first pin 52, a second pin 54 and a third pin 56. The first pin 52 is received in a first guide 62, the second pin 54 is received in a second guide 64 and the third pin 56 is received in a third guide 66. The first guide 62 can be positioned in the exhaust rocker arm 14. The second guide 64 can be defined through the engine brake actuator 26. The third guide 66 can be positioned in the exhaust rocker arm 14. A return spring 70 can urge the third pin 56 rightward as viewed in FIG. 1 in a direction into the actuator lever 42. The registering bolt 48 can align the latch pins 52, 54 and 56 in a way that each of them stays completely within the respective guides 62, 64 and 66.

Valve lash of the engine brake exhaust valve 32 over the valve bridge 22 may be adjusted by way of a valve lash screw 80 and nut 82. The valve lash set at a central contact point of the bridge 22 may be adjusted by way of an adjustment screw 86 and adjustment nut 88. In this regard, the nut 82 can be adjusted to provide a desired lost motion stroke LMS. Other configurations may be used.

When the engine is in drive (combustion) mode, the actuator piston 44 is retracted (solid line) and the actuator spring 46 keeps the actuator piston 44 away from the actuator lever 42. The latch pins 52, 54 and 56 are aligned so the engine brake actuator 26 can actuate through a lost motion stroke (move upwards) without creating motion of the exhaust valve 32. Motion of both the exhaust valves 30, 32 would move contemporary (full lift; opening and closing) and would be controlled only by the central E-foot 94.

Figure 4:
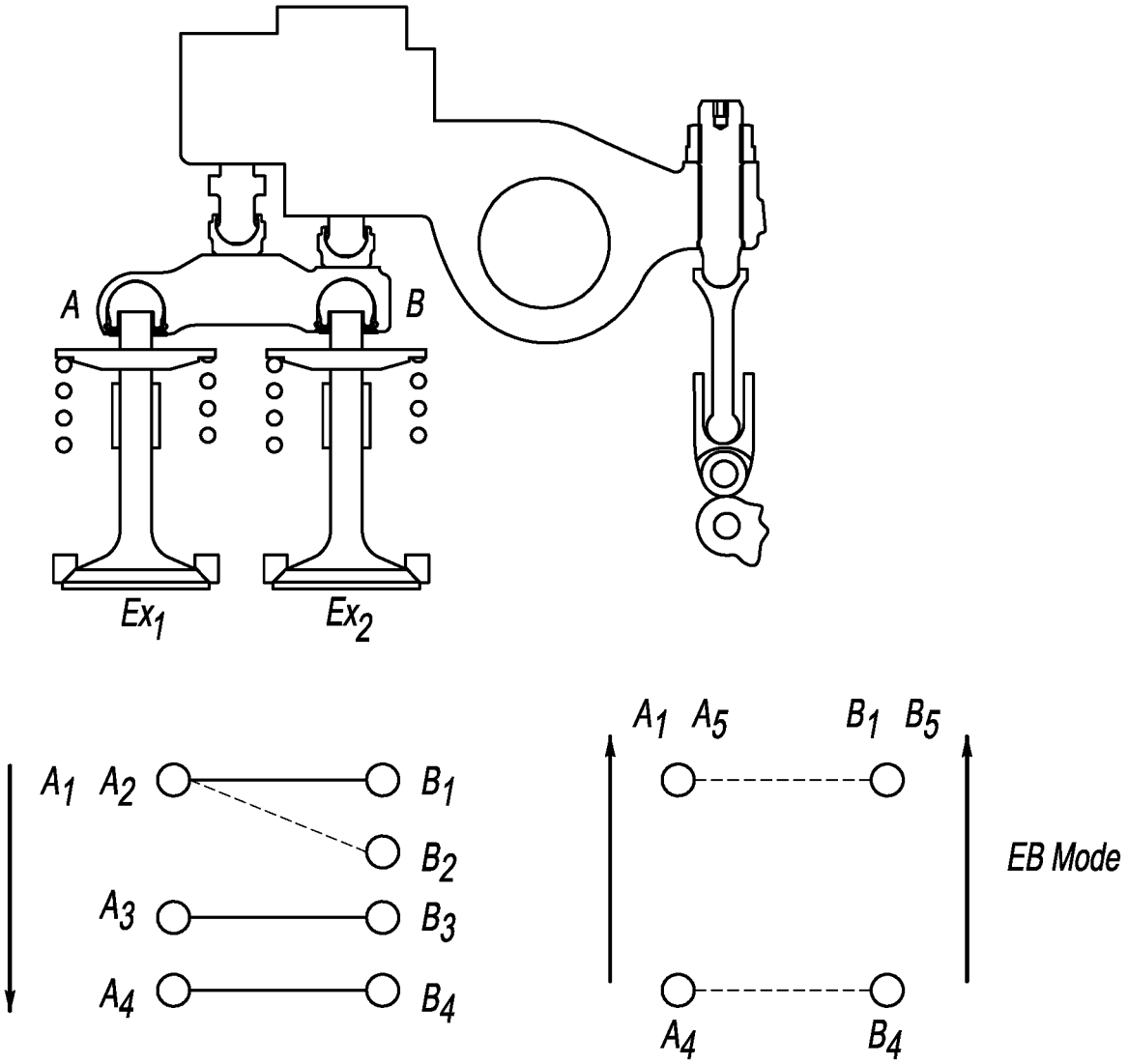
FIG. 4 is a representation of the valve bridge and exhaust valves based on movement of the engine brake actuator.

In braking mode, oil pressure (or other way of actuation including but not limited to electromechanical and pneumatic) identified at reference 100 will urge out the actuator piston 44 (phantom line) that will move the actuator lever 42 to a forward position (phantom line) and consequently the latch pins 52, 54 and 56 to engage and lock the engine brake actuator 26. Once the exhaust rocker arm 14 moves downward, the actuator lever 42 moves away from the actuator piston 44 and the engine brake actuator 26 is loaded and keeps the latch pins 52, 54 and 56 engaged. Once the EB actuator 26 is not loaded anymore (arrived to position A3-B3, FIG. 4), the return spring 66 will push back the pins 56, 54 and 52 in position that all the pins are aligned with the EB actuator body so that in valve closing, the EB actuator 26 will not become an "obstacle" to the exhaust valve 32 motion, and both valves 30 and 32 will close together.

Figure 2A:
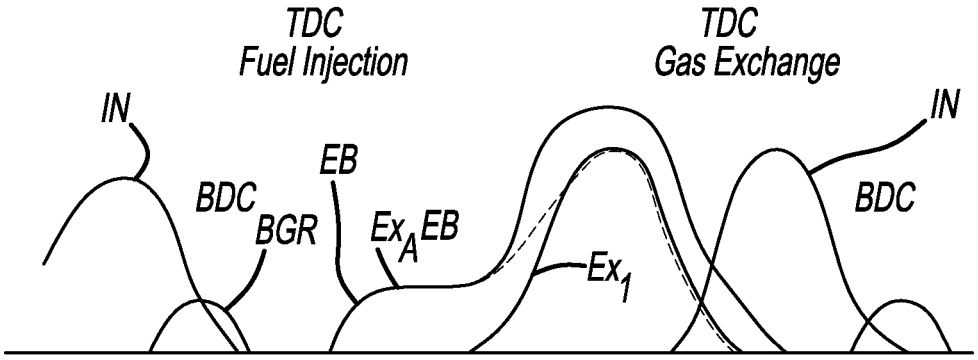
FIG. 2A is a plot showing cam lift, engine brake exhaust lift, non-engine brake exhaust lift with brake gas recirculation (BGR) and compression release (CR)
Figure 2B:
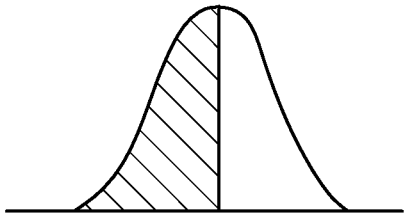
FIG. 2B is a plot showing the opening of one exhaust valve instead of two exhaust valves during engine braking operating mode.
Figure 3A:
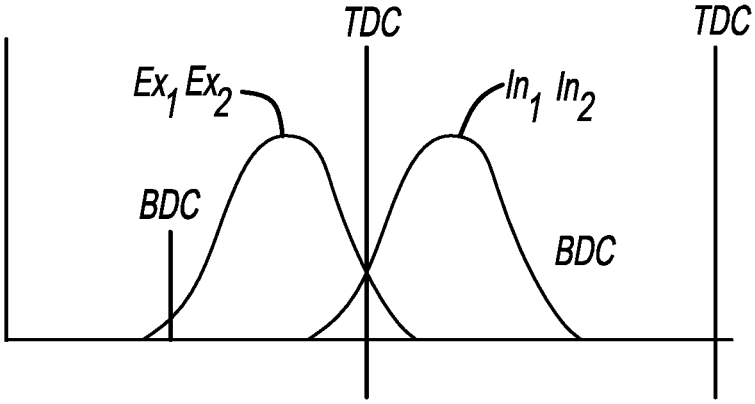
FIG. 3A illustrates a plot showing an exhaust valve and an intake valve lift in drive mode.
Figure 3B:
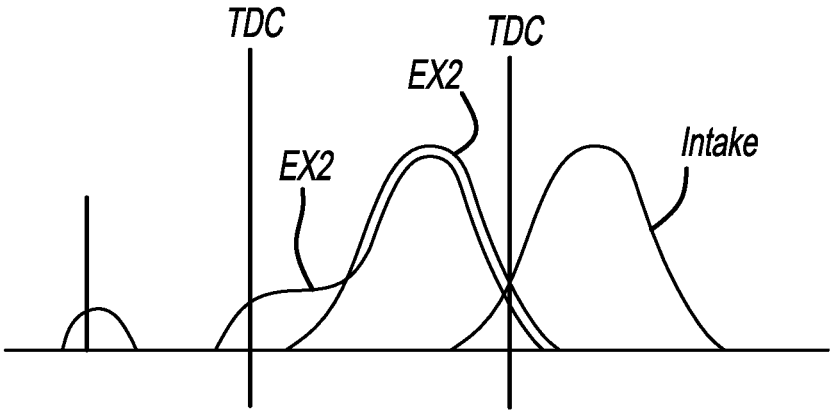
FIG. 3B illustrates a plot showing an exhaust valve and an intake valve lift in braking mode.

Turning now to FIG. 2A, a plot is shown illustrating cam lift, engine brake exhaust lift, non-engine brake exhaust lift with brake gas recirculation (BGR) and compression release (CR). Opening one of the exhaust valves 30, 32 instead of both of the exhaust valves 30, 32 during engine braking operating mode allows the engine brake exhaust valve 30 or 32 to open later in the compression stroke and in that way offer higher braking power. FIG. 2B is a plot showing the opening of one exhaust valve instead of two exhaust valves during engine braking operating mode. FIGS. 3A and 3B illustrate plots showing an exhaust valve and an intake valve lift in drive mode and in braking mode according to one example of the present disclosure.

With particular reference to FIGS. 1-4, additional features of the present disclosure will be described. The engine brake actuator 26 (FIG. 1) is engaged at the base circle (A1-B1), initially only one exhaust valve 32 (B) opens up to the moment the lost motion stroke (LMS, FIG. 1) becomes 0. At this point, the exhaust valve 30 starts moving. At point A3-B3 the valve bridge 22 becomes "horizontal". In this moment, all the valvetrain load is taken by the central E-foot 94. The engine brake actuator 26 is not loaded anymore and the return spring 70 now pushes the latch pins 52, 54 and 56 in an initial aligned position. The time available to this move to happen is from A3-B3 to A4-B4 and back to A3-B3 (valve closing path). Returning to A3-B3, the engine brake actuator 26 is loaded again but this time (as the latch pins 52, 54 and 56 are aligned), the engine brake actuator 26 moves upwards through lost motion and mis-aligned the latch pins 52, 54 and 56. Returning back (valve closing) the actuator lever 42 engages the actuator piston 44 but the actuator lever 42 cannot re-engage the pins. The actuator lever 42 will preload the actuator spring 46 associated with the actuator piston 44 and only when back on the base circle, the latch pins 52, 54 and 56 will again be aligned and the lever 42 will engage the engine brake actuator 26 again.

Turning now to FIGS. 5-14, an engine brake rocker arm assembly constructed in accordance to additional features is shown and generally identified at reference 110. The engine brake rocker arm assembly 110 includes an exhaust valve rocker arm assembly 112 incorporated in a valve train assembly that utilizes engine braking such as one having a pair of three-cylinder bank portions in a six-cylinder engine. It is appreciated however that the engine brake rocker arm assembly may be configured for incorporation in other engines.

The exhaust valve rocker arm assembly 112 includes an exhaust rocker arm 114 that rotates about a rocker shaft (see rocker shaft 16, FIG. 1). The exhaust valve rocker arm assembly 112 can include the engine brake rocker arm assembly 110 used in a configuration having the valve bridge 122, spigot assembly 124, and first and second exhaust valves 130, 132 (FIG. 1). Valve lash of the engine brake exhaust valve 132 over the valve bridge 122 may be adjusted by way of a valve lash screw 180 and nut 182.

Figure 11:
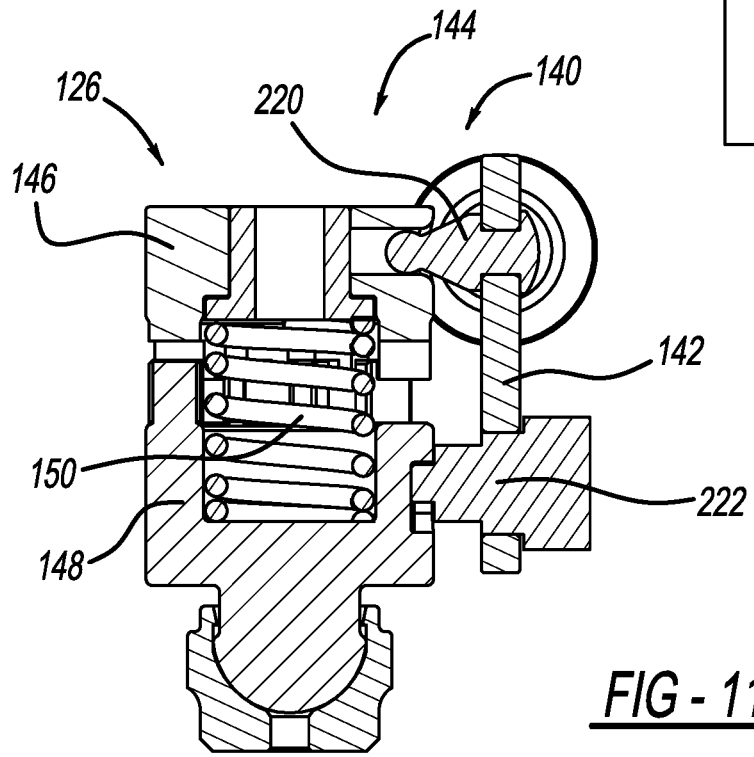
FIG. 11 is a sectional view taken along line 11-11 of the actuator assembly of the rocker arm of FIG. 5.
Figure 12:
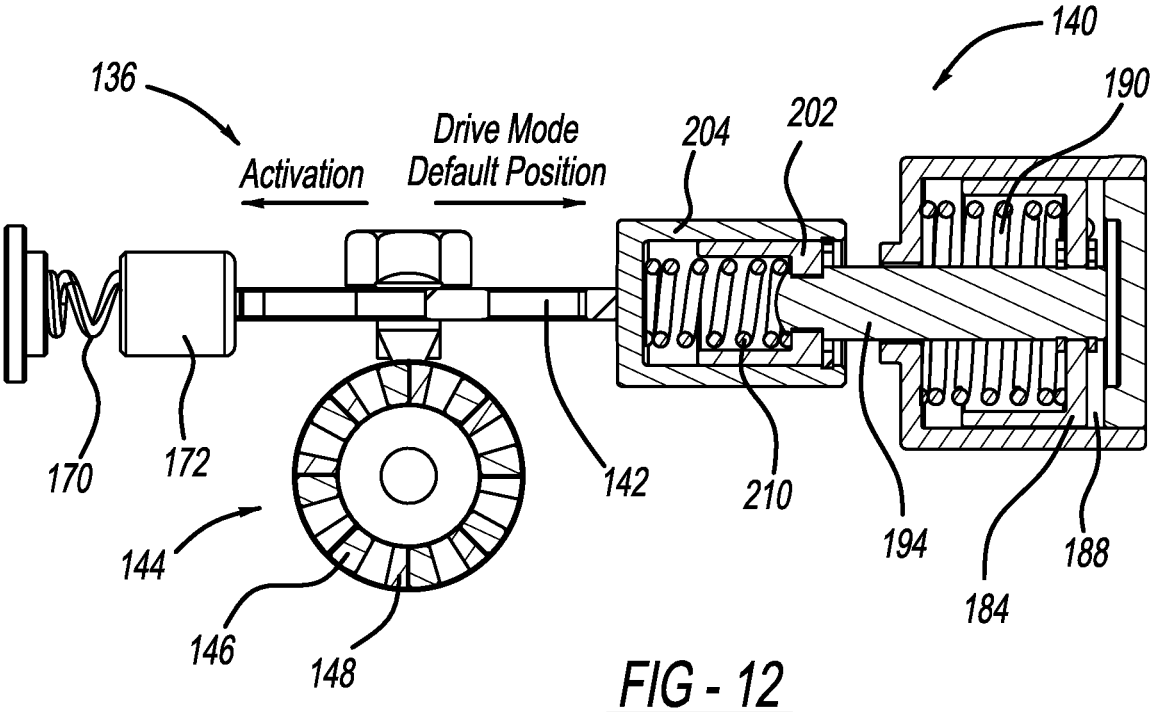
FIG. 12 is a top sectional view of the rocker arm of FIG. 5.

The engine brake rocker arm assembly 110 includes an engine brake actuation assembly constructed in accordance to additional features shown and generally identified at reference 136. The engine brake actuation assembly 136 generally includes an actuator assembly 140, an actuator lever 142 and an engine brake capsule or actuator 144. As will become appreciated from the following discussion, the engine brake actuator 144 is mechanically controlled between a latched position (FIG. 13) and an unlatched position (FIG. 14). The engine brake actuator 144 includes a first crown member 146, a second crown member 148 and a crown biasing member 150 (FIG. 11). The crown biasing member 150 biases the first and second crown members 146 and 148 apart. Because the engine brake actuator 144 is mechanically controlled, limitations associated with hydraulic control are eliminated.

The first and second crown members 146 and 148 are configured to move between a latched position (FIG. 13) and an unlatched position (FIG. 14). The first crown member 146 has a series of first teeth 152 and first valleys 154. The second crown member 148 has a series of second teeth 162 and second valleys 164. A return spring 170 can act against the actuator lever 142. The return spring 170 is housed in a return spring housing 172.

Figure 5:
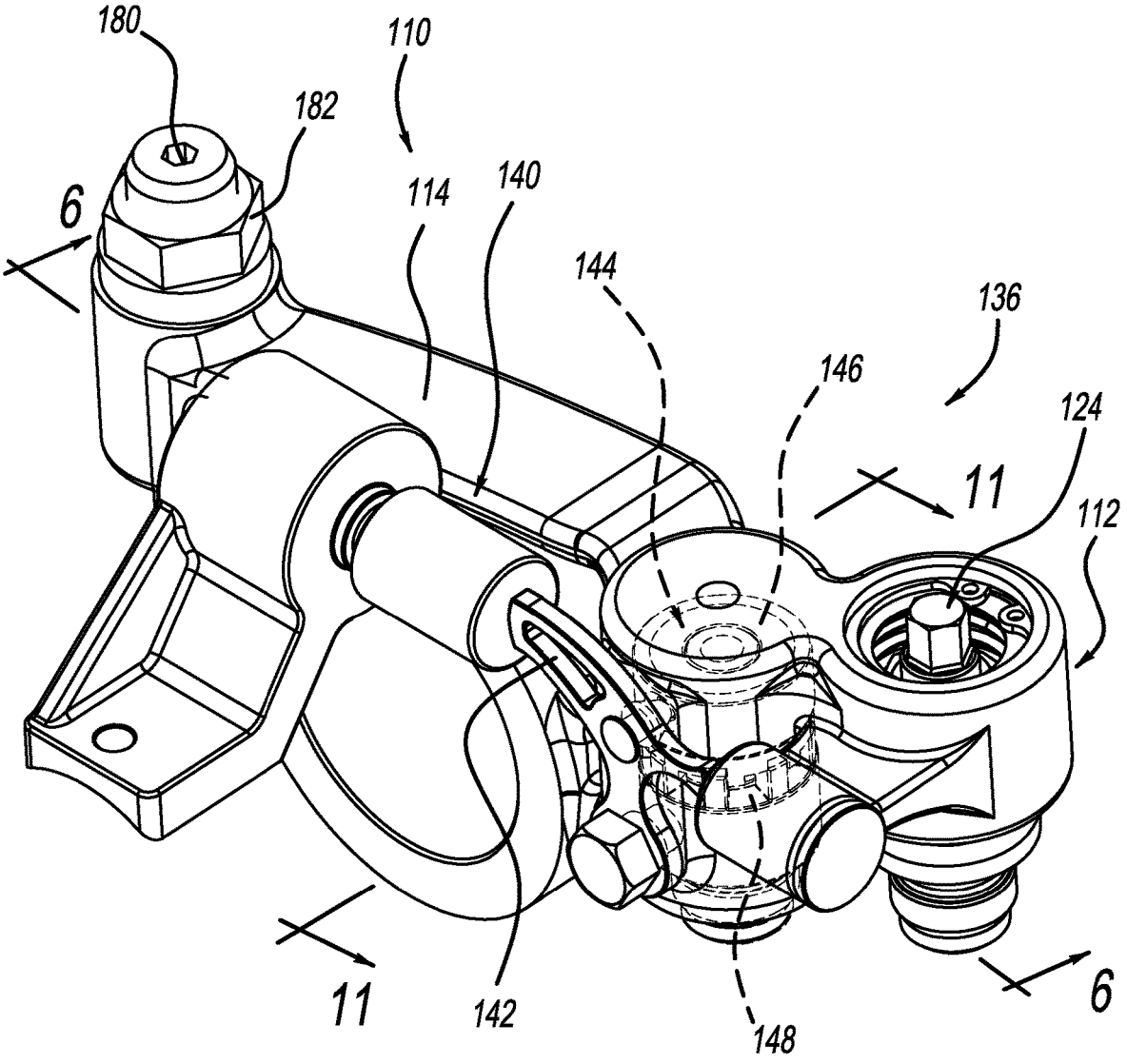
FIG. 5 is a perspective view of a rocker arm constructed in accordance to another example of the present disclosure and incorporating a crown-type latching mechanism according to additional features of the present disclosure.
Figure 6:
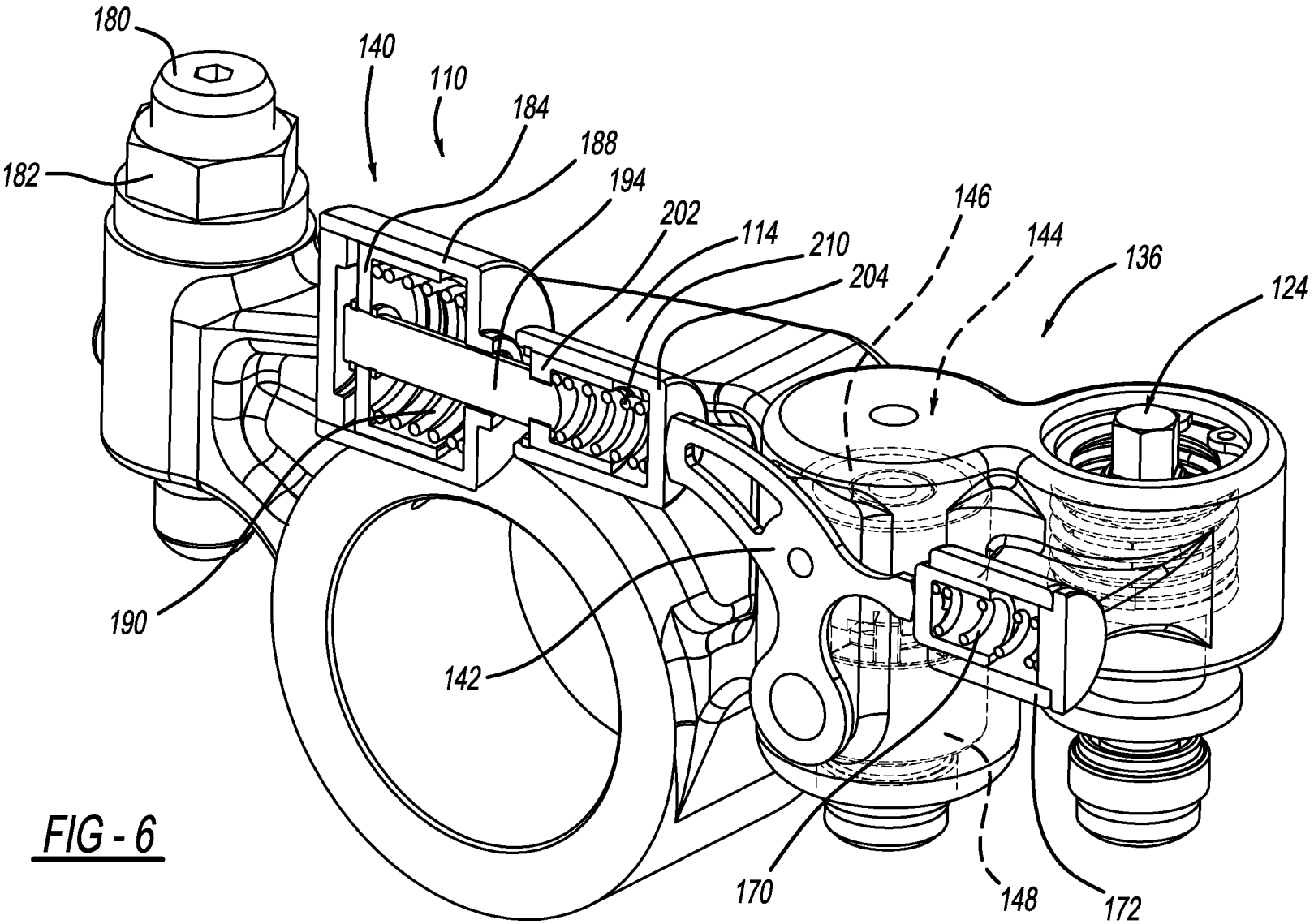
FIG. 6 is a cross-sectional view of the rocker arm taken along lines 6-6 of FIG. 5.
Figure 7:
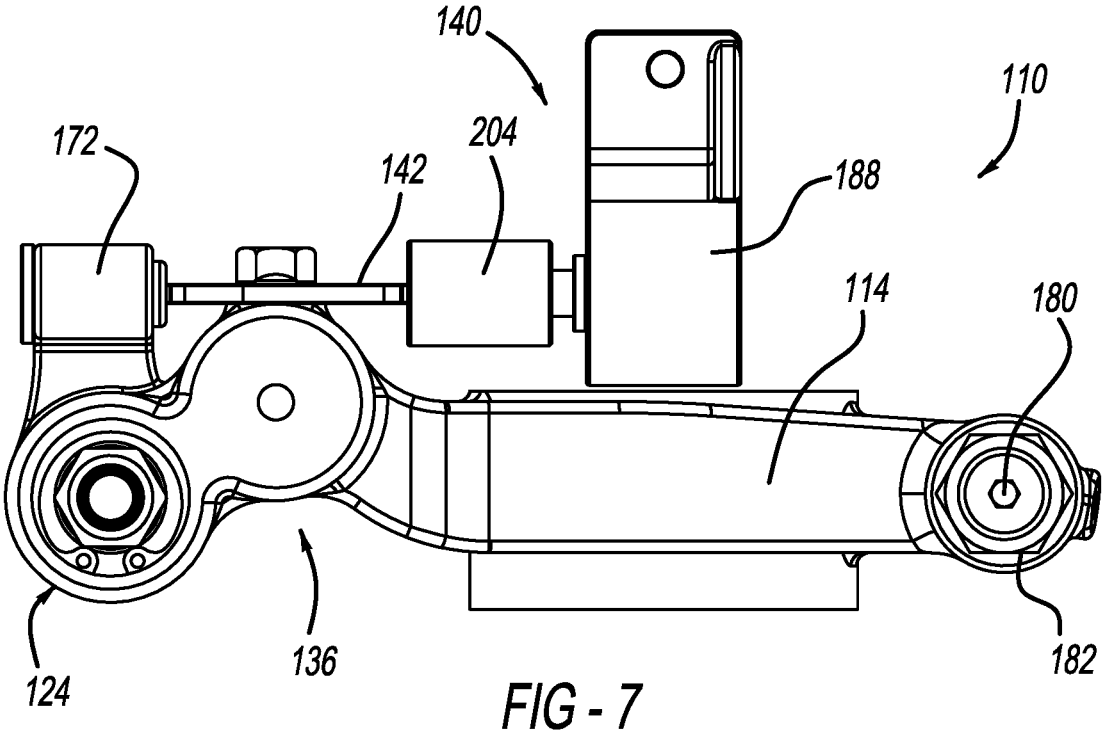
FIG. 7 is a top view of the rocker arm of FIG. 5.
Figure 8:
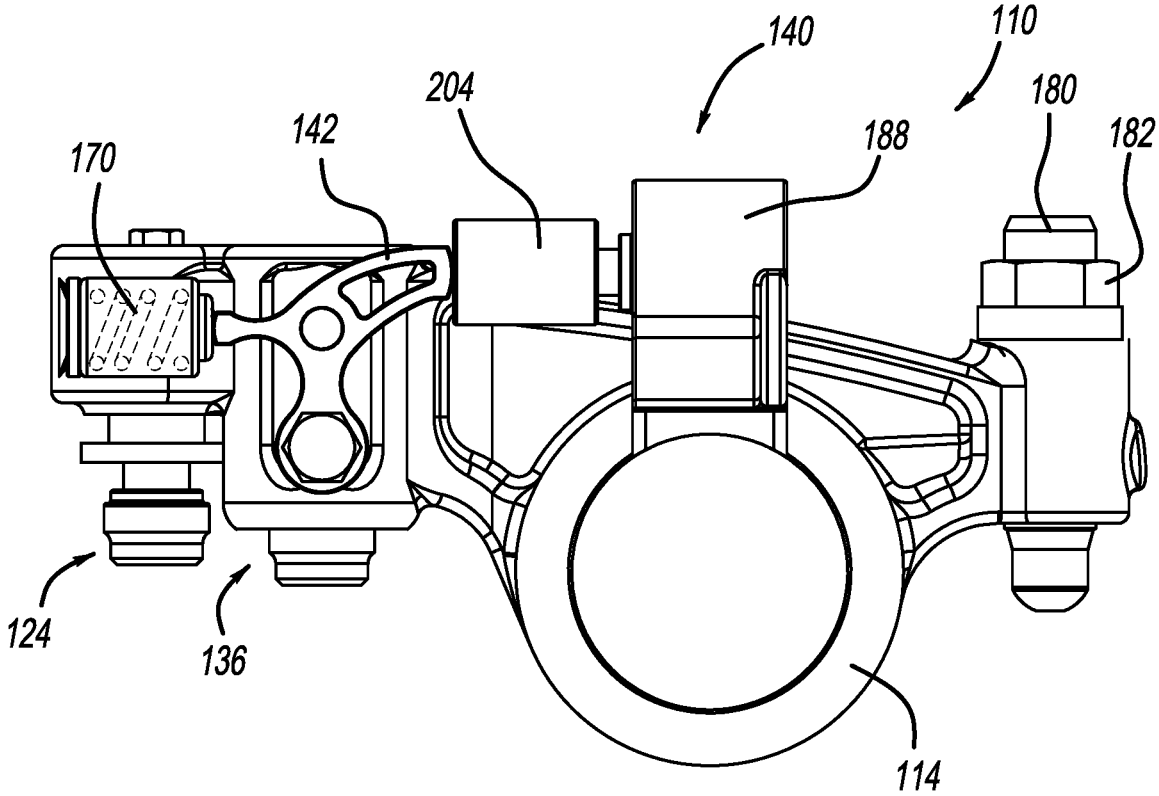
FIG. 8 is front view of the rocker arm of FIG. 5.
Figure 9:
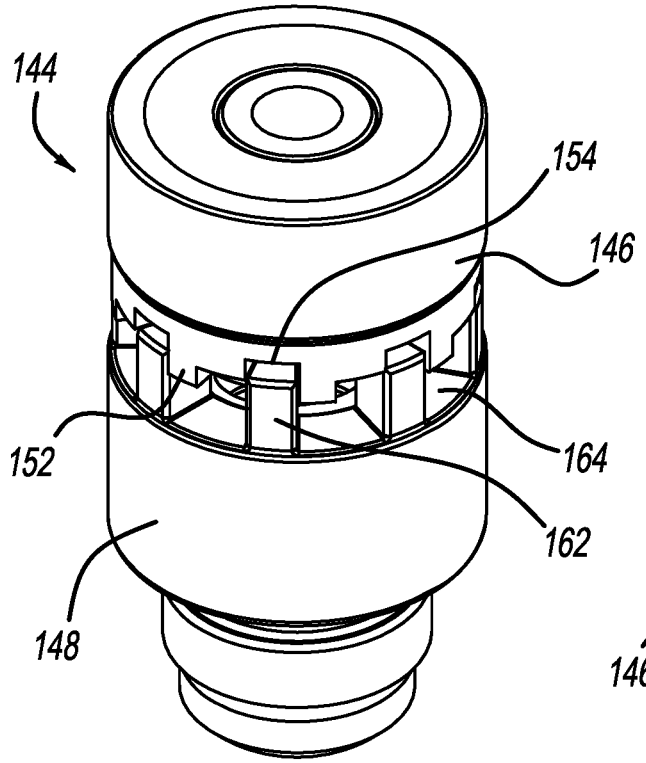
FIG. 9 is a perspective view of the crown-type latching mechanism of the rocker arm shown in FIG. 5.
Figure 10:
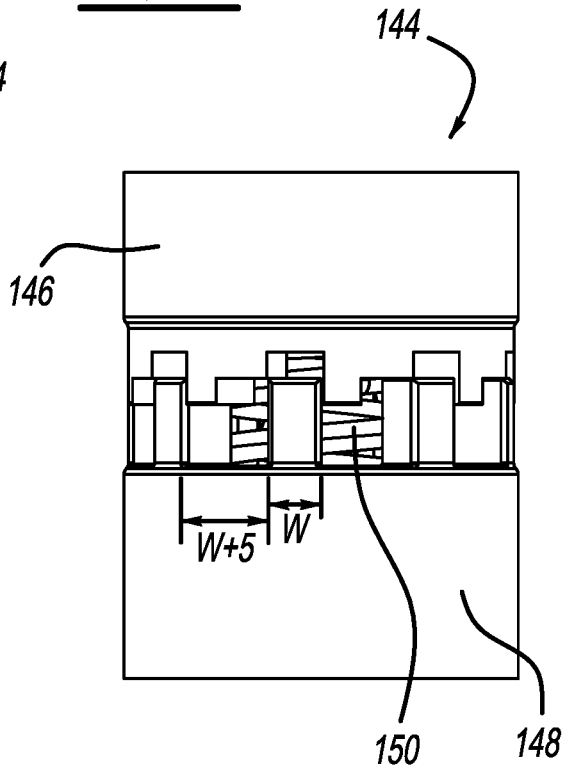
FIG. 10 is a close up view of a portion of the crown-type latching mechanism of the rocker arm shown in FIG. 9.

The actuator assembly 140 shown in FIG. 5 is hydraulically actuated and includes an actuator piston 184 that translates within an actuation cylinder 188. An actuation piston return spring 190 is biased between the actuator piston 184 and the actuation cylinder 188 to return the piston 184 in a direction leftward as shown in FIG. 6. The actuator piston 184 is fixed to an actuation shaft 194 that extends out of the actuation cylinder 188. The actuation shaft 194 is coupled on an opposite end to a compliance piston 202 received within a compliance cylinder 204. The actuator piston 184 and compliance piston 202 translate together during operation. A compliance spring 210 is biased between the compliance piston 202 and the compliance cylinder 204. In the example shown, the actuator piston 184 can actuate as a result of fluid entering the actuation cylinder 188 behind the actuator piston 184. The fluid can be pressurized engine oil or other hydraulic fluid.

Figure 5A:
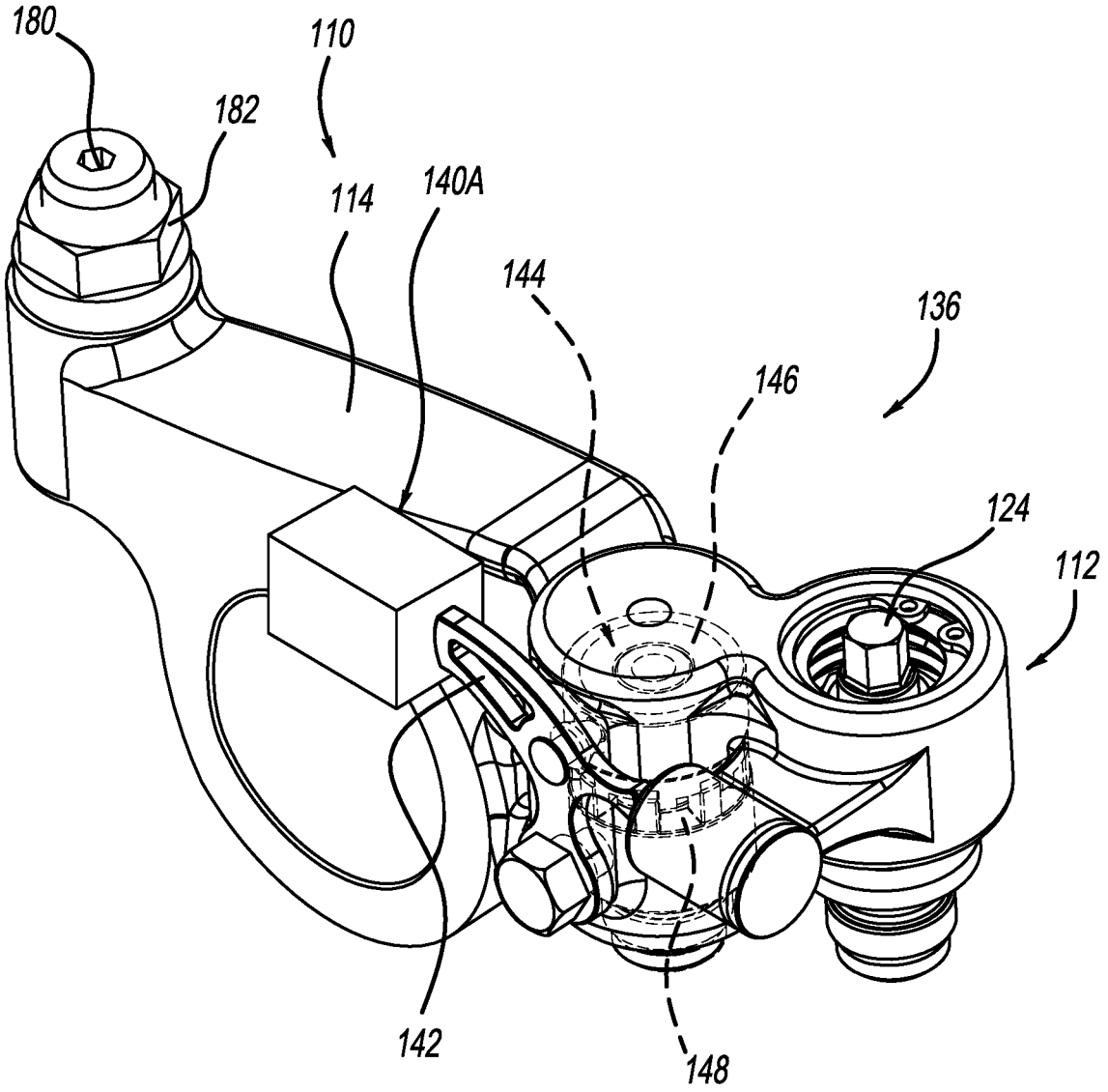
FIG. 5A is a perspective view of a rocker arm constructed in accordance to another example of the present disclosure and incorporating an alternate actuator assembly.

With reference to FIG. 5A, an actuator assembly 140A can take other forms. For example, the actuator assembly 140A can be a pneumatic actuator that that operates pneumatically with pressurized air to actuate the actuator lever 142. The actuator assembly 140A can alternatively be a solenoid actuator where the actuator lever 142 is actuated by solenoid actuation. Alternatively, the actuator assembly 140A can be an electromechanical actuator where the actuator lever 142 actuates based on electromechanical operation. Other configurations are contemplated within the scope of the present disclosure for actuating the engine brake actuator 144.

Figure 13:
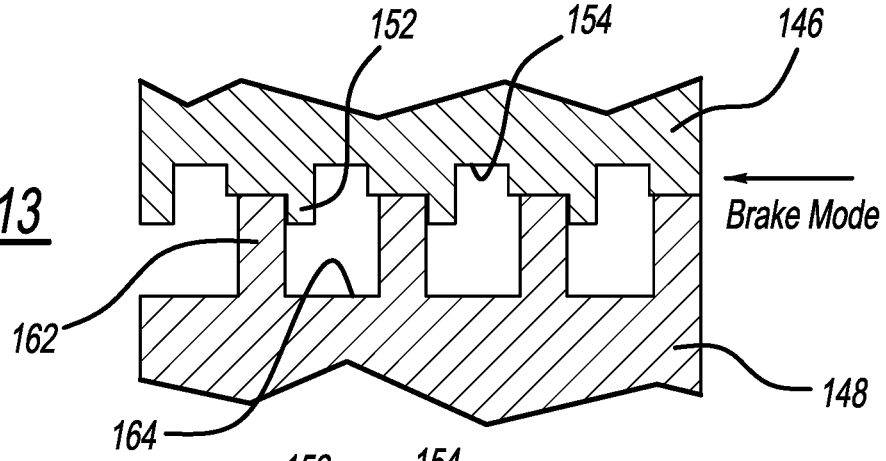
FIG. 13 is a partial sectional view of the crown-type latching mechanism of FIG. 9 and shown in brake mode.
Figure 14:
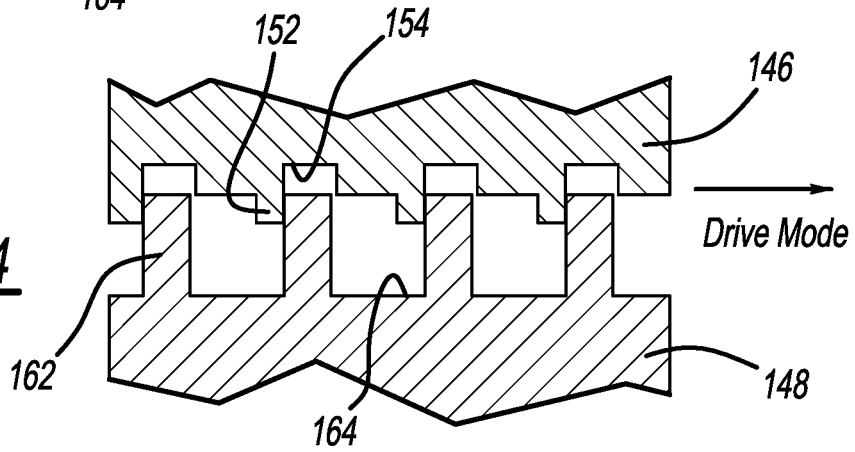
FIG. 14 is a partial sectional view of the crown-type latching mechanism of FIG. 9 and shown in drive mode.

In brake mode, the actuator assembly 140 actuates (actuator piston 184 translates rightward in FIG. 6) causing the lever 142 to rotate and therefore rotate the first crown member 146 to the position shown in FIG. 13. The series of first teeth 152 on the first crown member 146 can engage a first end of the series of second teeth 162 on the second crown member 148. The second teeth 162 engage the first crown member 146 causing the second crown member 148 to expand and ultimately open the exhaust valve 132. In drive mode, the actuator assembly 140 returns to an unactuated position (actuator piston 184 translates leftward in FIG. 6). The series of first teeth 152 on the first crown member 146 can engage a second end of the series of second teeth 162 on the second crown member 148. The second teeth 162 align with the valleys 154 such that the exhaust valve 132 is not caused to be open from the second crown member 148. In other words, the engine brake actuator or capsule 144 collapses. In the drive mode, the first and second exhaust valves 130 and 132 can be opened at the same time.

With particular reference to FIG. 11, a first finger 220 couples the actuator lever 142 to the first crown member 146. A second finger 222 couples the actuator lever 142 to the second crown member 148. Other configurations are contemplated.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An engine brake rocker arm assembly operable in an engine drive mode and an engine braking mode, the engine brake rocker arm assembly selectively opening first and second exhaust valves and comprising:

an exhaust valve rocker arm assembly having an exhaust rocker arm that is configured to rotate around a rocker shaft; and an engine brake actuation assembly comprising:

an actuator assembly;

an actuator lever; and a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve, wherein the actuator assembly is hydraulically actuated and includes an actuator piston that translates within an actuation cylinder causing movement of the actuator lever and ultimately movement of the mechanically controlled engine brake actuator between the first and second positions.

2. The engine brake rocker arm assembly of claim 1, wherein the actuator assembly further comprises an actuation shaft that extends out of the actuation cylinder and is coupled to a compliance piston received in a compliance cylinder, wherein the actuator piston and the compliance piston translate together.

3. The engine brake rocker arm assembly of claim 2, wherein the actuator assembly further comprises an actuation piston return spring biased between the actuator piston and the actuation cylinder, and a compliance spring biased between the compliance piston and the compliance cylinder.

4. The engine brake rocker arm assembly of claim 2, further comprising a return spring housed in a return spring housing and that is configured to act against the actuator lever to move the actuator lever toward the actuation shaft.

5. The engine brake rocker arm assembly of claim 1, wherein the engine brake actuator comprises a first crown member, a second crown member, and a crown biasing member that biases the first and second crown members apart.

6. The engine brake rocker arm assembly of claim 5, wherein the first crown member comprises a series of first teeth and first valleys, and wherein the second crown member comprises a series of second teeth and second valleys.

7. The engine brake rocker arm assembly of claim 6, wherein the first series of teeth oppose the second series of teeth in a latched position during the engine brake mode, and wherein the second series of teeth align with the first valleys in an unlatched position during the drive mode.

8. The engine brake rocker arm assembly of claim 7, wherein the first and second crown members are configured to rotate relative to each other when moving between the engine braking mode and the drive mode.

9. The engine brake rocker arm assembly of claim 7, wherein the engine brake actuator is configured to collapse during the drive mode.

10. The engine brake rocker arm assembly of claim 5, further comprising a first finger coupled between the actuator lever and the first crown member, and a second finger coupled between the actuator lever and the second crown member.

11. An engine brake rocker arm assembly operable in a combustion engine mode and an engine braking mode, the engine brake rocker arm assembly selectively opening first and second exhaust valves and comprising:

a rocker shaft;

an exhaust valve rocker arm assembly having an exhaust rocker arm that receives the rocker shaft and is configured to rotate around the rocker shaft;

an actuator assembly having an engine brake actuator, an actuator lever, an actuator piston, and an actuator spring; and a latch pin assembly that cooperates with the actuator assembly, wherein, in combustion engine mode, the actuator piston and the actuator lever are in a retracted position such that the first and second exhaust valves are configured to move contemporaneously, and in engine braking mode, the actuator piston and the actuator lever are in a forward position such that the latch pin assembly locks the engine brake actuator.

12. The engine brake rocker arm assembly of claim 11, wherein the engine brake actuator is slidably received along an inner diameter of the exhaust rocker arm, and wherein the engine brake actuator is selectively translatable upon urging by the exhaust rocker arm, the engine brake actuator, in turn, being configured to urge one of the first and second exhaust valves open during engine braking mode.

13. The engine brake rocker arm assembly of claim 11, wherein the latch pin assembly further comprises:

a first pin received by a first guide positioned in the exhaust rocker arm;

a second pin received by a second guide in the engine brake actuator; and a third pin received by a third guide in the exhaust rocker arm.

14. The engine brake rocker arm assembly of claim 13, further comprising a return spring that is configured to urge the third pin toward the actuator lever.

15. The engine brake rocker arm assembly of claim 13, further comprising a registering bolt that is configured to align the first, second, and third latch pins.

16. An engine brake rocker arm assembly operable in an engine drive mode and an engine braking mode, the engine brake rocker arm assembly selectively opening first and second exhaust valves and comprising:

an exhaust valve rocker arm assembly having an exhaust rocker arm that is configured to rotate around a rocker shaft; and an engine brake actuation assembly comprising:

an actuator assembly;

an actuator lever;

a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve; and a spigot assembly disposed in the exhaust rocker arm and that is configured to engage a valve bridge engaged to the first and second exhaust valves, wherein the actuator assembly is hydraulically actuated and includes an actuator piston that translates within an actuation cylinder causing movement of the actuator lever and ultimately movement of the mechanically controlled engine brake actuator between the first and second positions.

17. An engine brake rocker arm assembly operable in an engine drive mode and an engine braking mode, the engine brake rocker arm assembly selectively opening first and second exhaust valves and comprising:

an exhaust valve rocker arm assembly having an exhaust rocker arm that is configured to rotate around a rocker shaft; and an engine brake actuation assembly comprising:

an actuator assembly;

an actuator lever; and a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve, wherein the actuator assembly is hydraulically actuated and includes an actuator piston that translates within an actuation cylinder causing movement of the actuator lever and ultimately movement of the mechanically controlled engine brake actuator between the first and second positions, wherein the actuator assembly further comprises an actuation shaft that extends out of the actuation cylinder and is coupled to a compliance piston received in a compliance cylinder, wherein the actuator piston and the compliance piston translate together, and wherein the actuator assembly further comprises an actuation piston return spring biased between the actuator piston and the actuation cylinder, and a compliance spring biased between the compliance piston and the compliance cylinder.

18. An engine brake rocker arm assembly operable in an engine drive mode and an engine braking mode, the engine brake rocker arm assembly selectively opening first and second exhaust valves and comprising:

an exhaust valve rocker arm assembly having an exhaust rocker arm that is configured to rotate around a rocker shaft; and an engine brake actuation assembly comprising:

an actuator assembly;

an actuator lever; and a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve, wherein the actuator assembly is hydraulically actuated and includes an actuator piston that translates within an actuation cylinder causing movement of the actuator lever and ultimately movement of the mechanically controlled engine brake actuator between the first and second positions, wherein the engine brake actuator comprises a first crown member, a second crown member, and a crown biasing member that biases the first and second crown members apart, wherein the first crown member comprises a series of first teeth and first valleys, and wherein the second crown member comprises a series of second teeth and second valleys.

19. The engine brake rocker arm assembly of claim 18, wherein the first series of teeth oppose the second series of teeth in a latched position during the engine brake mode, and wherein the second series of teeth align with the first valleys in an unlatched position during the drive mode.

20. The engine brake rocker arm assembly of claim 19, wherein the first and second crown members are configured to rotate relative to each other when moving between the engine braking mode and the drive mode.

21. The engine brake rocker arm assembly of claim 19, wherein the engine brake actuator is configured to collapse during the drive mode.

22. An engine brake rocker arm assembly operable in an engine drive mode and an engine braking mode, the engine brake rocker arm assembly selectively opening first and second exhaust valves and comprising:

an exhaust valve rocker arm assembly having an exhaust rocker arm that is configured to rotate around a rocker shaft; and an engine brake actuation assembly comprising:

an actuator assembly;

an actuator lever; and a mechanically controlled engine brake actuator configured to move between a first position corresponding to the engine brake mode wherein the second exhaust valve is opened prior to the first exhaust valve, and a second position corresponding to the drive mode wherein the second valve is not opened prior to the first exhaust valve, wherein the actuator assembly is hydraulically actuated and includes an actuator piston that translates within an actuation cylinder causing movement of the actuator lever and ultimately movement of the mechanically controlled engine brake actuator between the first and second positions, wherein the engine brake actuator comprises a first crown member, a second crown member, and a crown biasing member that biases the first and second crown members apart, and wherein the engine brake rocker arm assembly further comprises a first finger coupled between the actuator lever and the first crown member, and a second finger coupled between the actuator lever and the second crown member.

* * * * *